US011731003B2

(12) United States Patent
Kuo

(10) Patent No.: US 11,731,003 B2
(45) Date of Patent: Aug. 22, 2023

(54) ELLIPTICAL EXERCISER CAPABLE OF ADJUSTING STRIDE LENGTH

(71) Applicant: Sports Art Industrial Co., Ltd., Tainan (TW)

(72) Inventor: Hai-Pin Kuo, Tainan (TW)

(73) Assignee: Sports Art Industrial Co., Ltd., Tainan (TW)

( * ) Notice: Subject to any disclaimer, the term of this patent is extended or adjusted under 35 U.S.C. 154(b) by 0 days.

(21) Appl. No.: 17/481,178

(22) Filed: Sep. 21, 2021

(65) Prior Publication Data

US 2022/0134180 A1 May 5, 2022

(30) Foreign Application Priority Data

Nov. 2, 2020 (TW) ..... 109138130

(51) Int. Cl.
*A63B 22/06* (2006.01)
*A63B 22/00* (2006.01)

(52) U.S. Cl.
CPC ..... *A63B 22/0664* (2013.01); *A63B 22/001* (2013.01); *A63B 22/0017* (2015.10); *A63B 2022/0682* (2013.01)

(58) Field of Classification Search
CPC ... A63B 22/0664–0694; A63B 23/035–03591; A63B 2220/22
See application file for complete search history.

(56) References Cited

U.S. PATENT DOCUMENTS 5,290,211 A * 3/1994 Stearns ..... A63B 22/001 482/53
5,401,226 A * 3/1995 Stearns ..... A63B 22/203 482/53
6,390,953 B1 * 5/2002 Maresh ..... A63B 22/0015 482/52
6,454,682 B1 * 9/2002 Kuo ..... A63B 22/0664 482/52
7,448,986 B1 * 11/2008 Porth ..... A63B 22/001 482/52
7,455,624 B2 * 11/2008 Liao Lai ..... A63B 22/0664 482/52
7,608,018 B2 * 10/2009 Chuang ..... A63B 22/0664 482/52
7,651,445 B1 * 1/2010 Chen ..... A63B 22/001 482/52

(Continued)

*Primary Examiner* — Nyca T Nguyen

(57) ABSTRACT

An elliptical exerciser capable of adjusting a stride length contains: frame, a transmission device, a crank mechanism, and an adjustable movement unit. The transmission device is connected on the pedestal and includes a pulley. The crank mechanism is coaxial with the pulley of the transmission device and is rotatably connected on the frame. The adjustable movement unit is rotatably connected on the frame and is coupled with the transmission device via the crank mechanism. The adjustable movement unit includes two four-connection-rod assemblies which are located on two sides of the frame, and a respective four-connection-rod assembly of the adjustable movement unit has an adjustment lever, a post, a manual swing lever, and a horizontal joining rod. The adjustment lever has multiple rotatable connection points which are spaced, and the manual swing lever is rotatably connected on the frame.

7 Claims, 7 Drawing Sheets

(56) References Cited

U.S. PATENT DOCUMENTS

| | | | | |
|---|---|---|---|---|
| 7,841,968 | B1 * | 11/2010 | Eschenbach | A63B 22/0017 482/52 |
| 9,630,052 | B2 * | 4/2017 | Peng | A63B 23/03591 |
| 9,925,412 | B1 * | 3/2018 | Lu | A63B 22/001 |
| 10,022,588 | B1 * | 7/2018 | Lee | A63B 23/03525 |
| D864,315 | S * | 10/2019 | Hume | D21/670 |
| 10,806,965 | B2 * | 10/2020 | Lee | A63B 21/4035 |
| 11,484,749 | B2 * | 11/2022 | Rogus | A63B 22/0664 |
| 2001/0051562 | A1 * | 12/2001 | Stearns | A63B 22/001 482/52 |
| 2007/0238582 | A1 * | 10/2007 | Lee | A63B 22/0015 482/52 |
| 2008/0261777 | A1 * | 10/2008 | Chuang | A63B 22/001 482/52 |
| 2008/0261778 | A1 * | 10/2008 | Chuang | A63B 22/001 482/52 |
| 2008/0261779 | A1 * | 10/2008 | Chuang | A63B 22/0664 482/52 |
| 2008/0274860 | A1 * | 11/2008 | Lee | A63B 22/001 482/52 |
| 2014/0249000 | A1 * | 9/2014 | Lu | A63B 22/001 482/52 |
| 2014/0309086 | A1 * | 10/2014 | Chuang | A63B 22/0015 482/57 |
| 2017/0014675 | A1 * | 1/2017 | Lai | A63B 22/0664 |

* cited by examiner

ELLIPTICAL EXERCISER CAPABLE OF ADJUSTING STRIDE LENGTH

FIELD OF THE INVENTION

The present invention relates to an elliptical exerciser capable of adjusting stride length, and more particularly to the elliptical exerciser which is capable of adjusting the foot movement trajectory and the stride length of the pedal.

BACKGROUND OF THE INVENTION

Although the nature of indoor sports equipment is different from outdoor sports, at this stage, various indoor sports equipment in different fields can demonstrate the training of various muscles of the body, so that consumers can perform physical training even at home or indoors to achieve fitness or for the purpose of rehabilitation. Therefore, indoor sports equipment has been widely preferred by consumers, such as sports treadmills, steppers, rowing machines, exercise bikes, etc., which are commonly used by consumers. And for indoor sports equipment in recent years, with the continuous innovation of the old and the new, a sports machine that can form a trajectory is widely loved by general consumers.

However, the exercise machine basically still has the function of training physical fitness, but the trajectory formed by the conventional exercise machine during exercise is only a single type, and its trajectory cannot be adjusted, and when using the existing exercise machine, the user must match the footsteps with the gait trajectory of the exercise machine. If the gait trajectory of the exercise machine is poorly designed, it will easily lead to muscle soreness and long-term accumulation of sports injuries.

The present invention has arisen to mitigate and/or obviate the afore-described disadvantages.

SUMMARY OF THE INVENTION

The primary aspect of the present invention is to provide an elliptical exerciser by which the second rotatable fixing segment of the horizontally fixing rod and the adjustment lever of the adjustment unit is adjustable so that the first horizontal distance defined by the elliptical-like movement path changes, and the manual swing lever rotates along the rotatable connecting point of the manual swing lever, wherein the arcuate swing length of the third rotatable fixing segment of the horizontal fixing rod and the bottom segment of the manual swing lever changes so as to adjust the foot movement trajectory and the stride length of the pedal.

Further aspect of the present invention is to provide an elliptical exerciser by which the movement trajectory of the pedal is the elliptical-like movement path when stepping the pedal, wherein the elliptical-like movement path has the upper plane section and the lower arcuate section, thus decreasing sport injury and obtaining ergonomics and exercising safety.

DETAILED DESCRIPTION OF THE PREFERRED EMBODIMENTS

Figure 1:
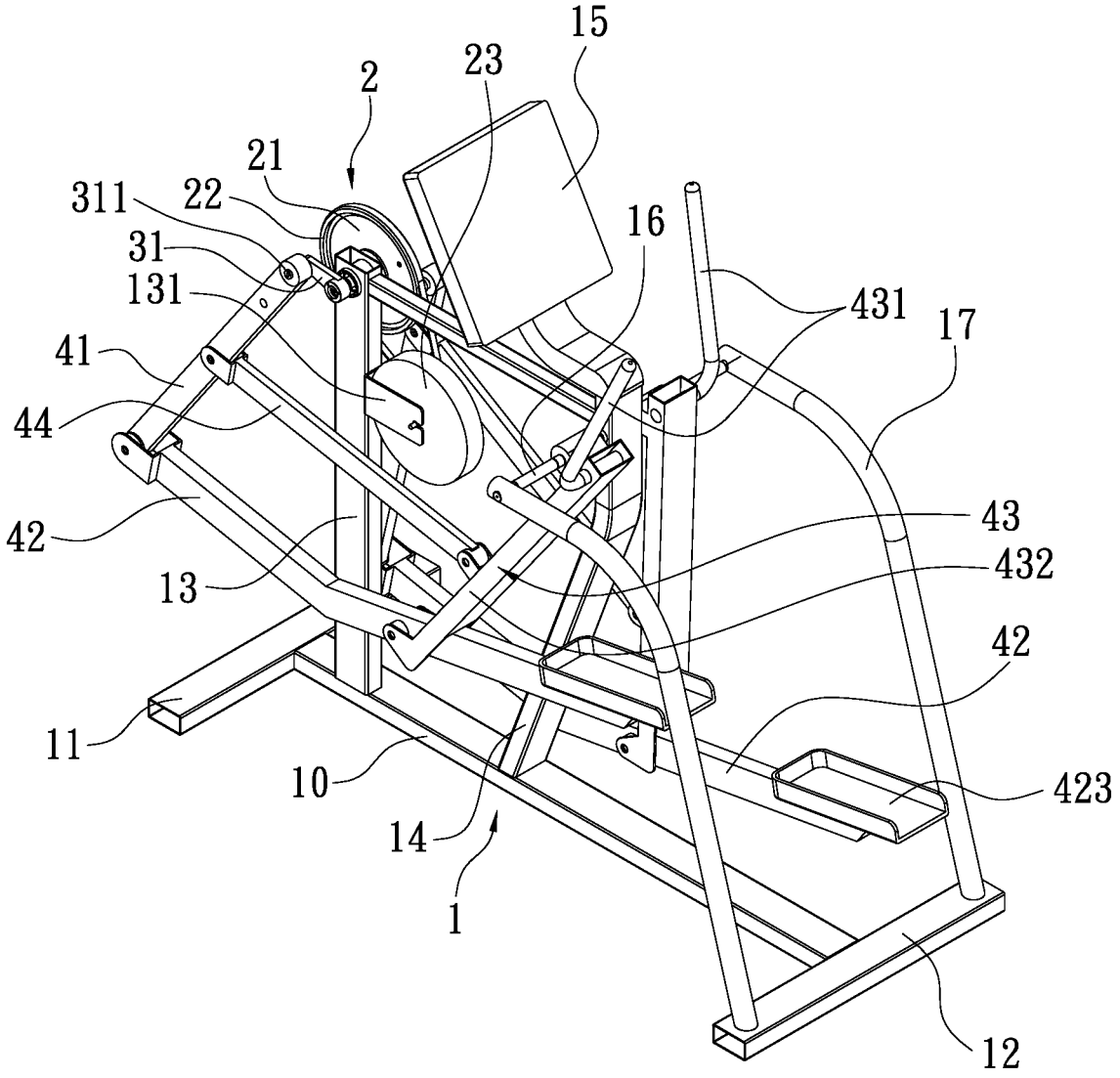
FIG. 1 is a perspective view showing the assembly of an elliptical exerciser according to a first embodiment of the present invention.

With reference to FIGS. 1-5, an elliptical exerciser capable of adjusting a stride length according to a first embodiment of the present invention comprises: a frame 1, a transmission device 2, a crank mechanism 3, and an adjustable movement unit 4.

The frame 1 includes a pedestal 10, a first fixing rod 11 and a second fixing rod 12 which are mounted on two ends of the pedestal 10, a first column 13 extending upward from one of the two ends of the pedestal 10 proximate to the first fixing rod 11, a second column 14 extending upward from a middle section of the pedestal 10, and a control member 15 fixed on a top of the second column 14, wherein the control member is a dashboard or an electronic panel. The pedestal 10 further includes two stems 16 extending symmetrically outward from the second column 14 below the control member 15, and two handrails 17 connected on and extending upward from two sides of the second fixing rod 12 of the pedestal 1 and defined among the two stems 16 and the second fixing rod 12.

The transmission device 2 is connected on the frame 1 and includes a pulley 21, a belt 22, and a steel wheel 23, wherein the pulley 21 is mounted on a top of the first column 13 of the pedestal 1, and the first column 13 has a rotatable connection seat 131 disposed thereon beside the steel wheel 23 and below the pulley 21, wherein the belt 22 is fitted on the pulley 21 and a pillar of the steel wheel 23.

The crank mechanism 3 includes a coupling shaft 30 coaxial with the pulley 21 of the transmission device 2 and is rotatably connected on the first column 13 of the frame 1, wherein a first end of the coupling shaft 30 is rotatably connected on a first end of a first crank arm 31, a second end of the first crank arm 31 is rotatably connected with a first bolt 311, a second end of the coupling shaft 30 is rotatably connected on a first end of a second crank arm 32, and a second end of the second crank arm 32 is rotatably with a second bolt 321.

Figure 2:
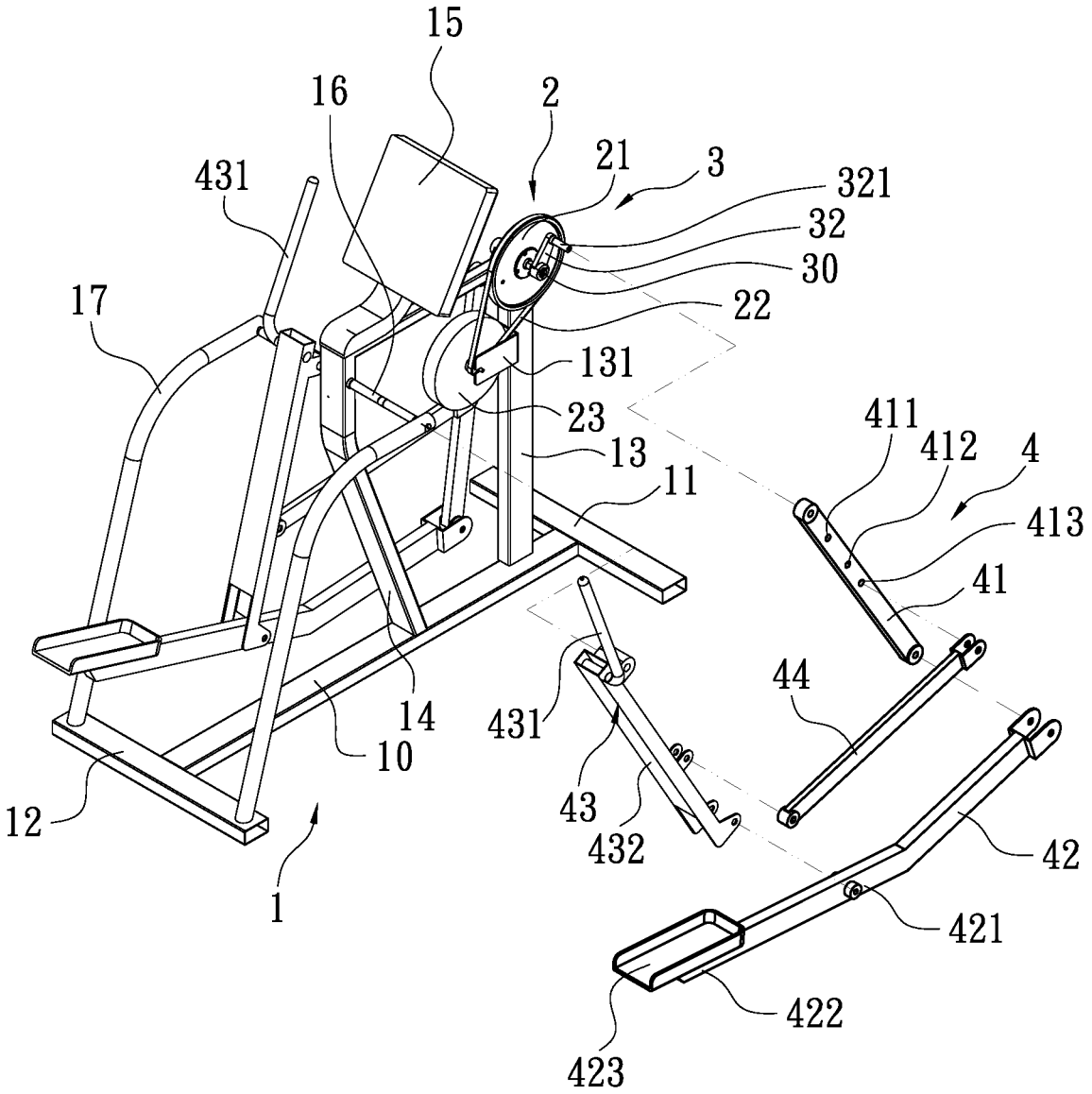
FIG. 2 is a perspective view showing the exploded components of the elliptical exerciser according to the first embodiment of the present invention.

The adjustable movement unit 4 is rotatably connected on the frame 1 and is coupled with the transmission device 3 via the crank mechanism 3. The adjustable movement unit 4 includes two four-connection-rod assemblies which are located on two sides of the frame 1, wherein a respective four-connection-rod assembly of the adjustable movement unit 4 has an adjustment lever 41, a post 42, a manual swing lever 43, and a horizontal joining rod 44. Taking the adjustable movement unit 4 rotatably connected on the second bolt 321 of the crank mechanism 3 for example, as shown in FIG. 2, a top of the adjustment lever 41 is rotatably connected on the second bolt 321 of the crank mechanism 3, and a bottom of the adjustment lever 41 is coupled with a first end of the post 42, wherein the adjustment lever 41 has three rotatable connection points 411, 412, 413 which are spaced, and the manual swing lever 43 is rotatably connected on the two stems 16 of the frame 1, wherein the manual swing lever 43 are defined to a top segment 431 and a bottom segment 432 by using a rotatable connecting point C of the manual swing lever 43, and the bottom segment 432 is connected to a second end of post 42. As illustrated in FIG. 2, the bottom segment 432 is connected to an intermediate section 421 of the post 42, and a connection portion of the bottom segment 432 and the intermediate section 421 is a first rotatable fixing segment P4, wherein the post 42 has a pedal 423 connected on a distal segment 422 thereof, a first end of the horizontal joining rod 44 is rotatably connected on one of the three rotatable connection points 411, 412, 413 of the adjustment lever 41, a connection portion of the first end of the horizontal joining rod 44 and one of the three rotatable connection points 411, 412, 413 is defined as a second rotatable fixing segment P, and a second end of the horizontal joining rod 44 is rotatably connected on a middle section of the bottom segment 432 of the manual swing lever 43, wherein a connection portion of the second end of the horizontal joining rod 44 and the middle section of the bottom segment 432 is defined as a third rotatable fixing segment P0.

Figure 3:
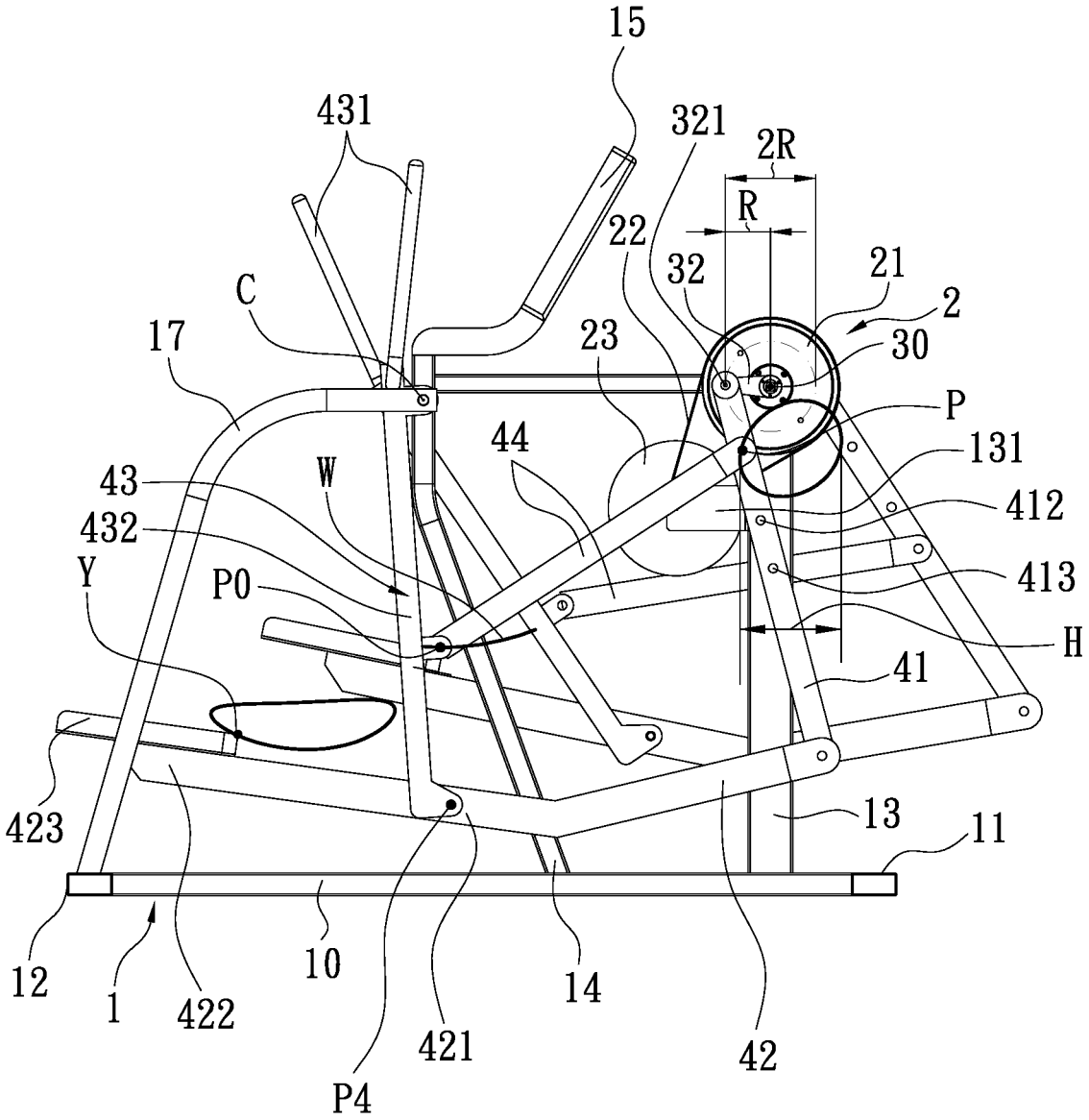
FIG. 3 is a side plan view showing the assembly of the elliptical exerciser according to the first embodiment of the present invention.
Figure 4:
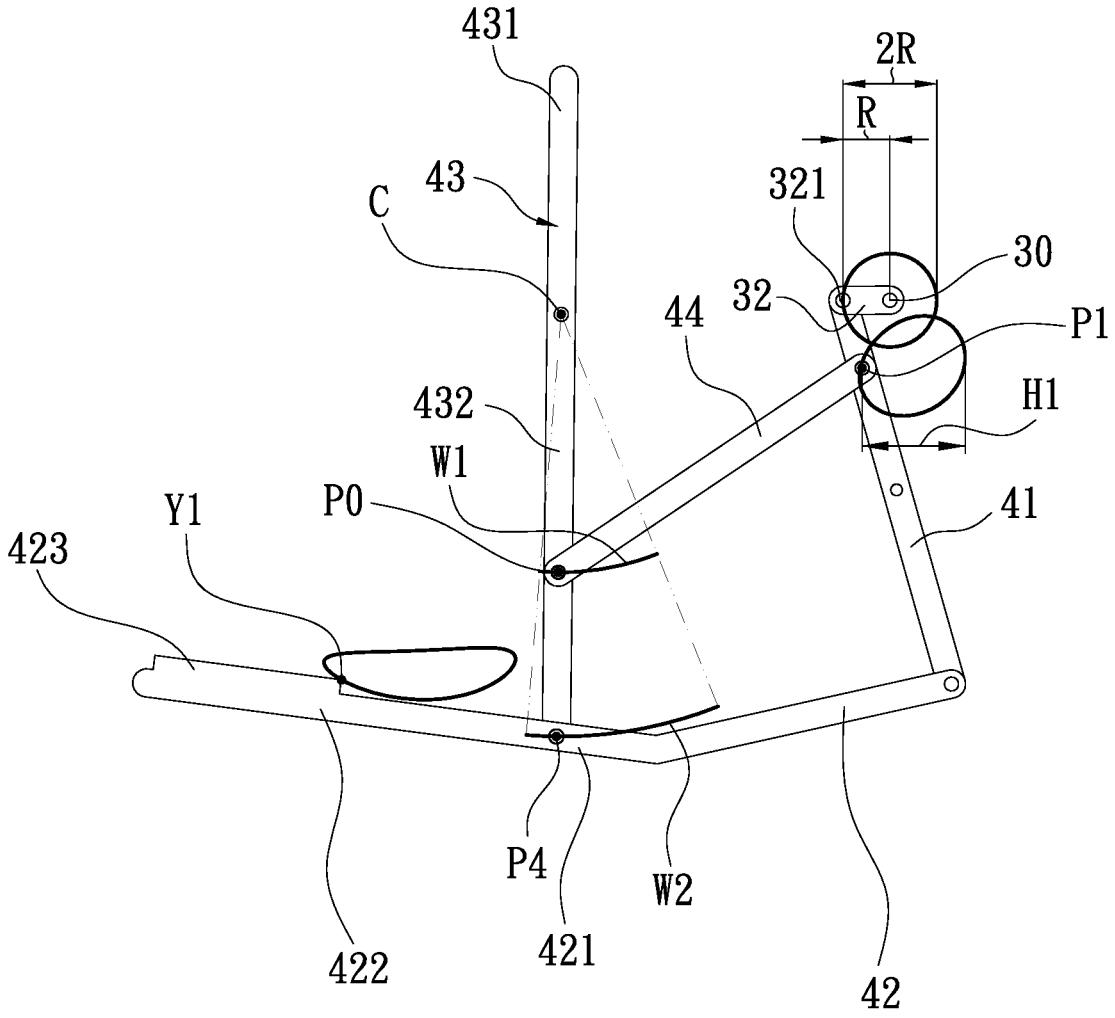
FIG. 4 is another side plan view showing the operation of the elliptical exerciser according to the first embodiment of the present invention.
Figure 5:
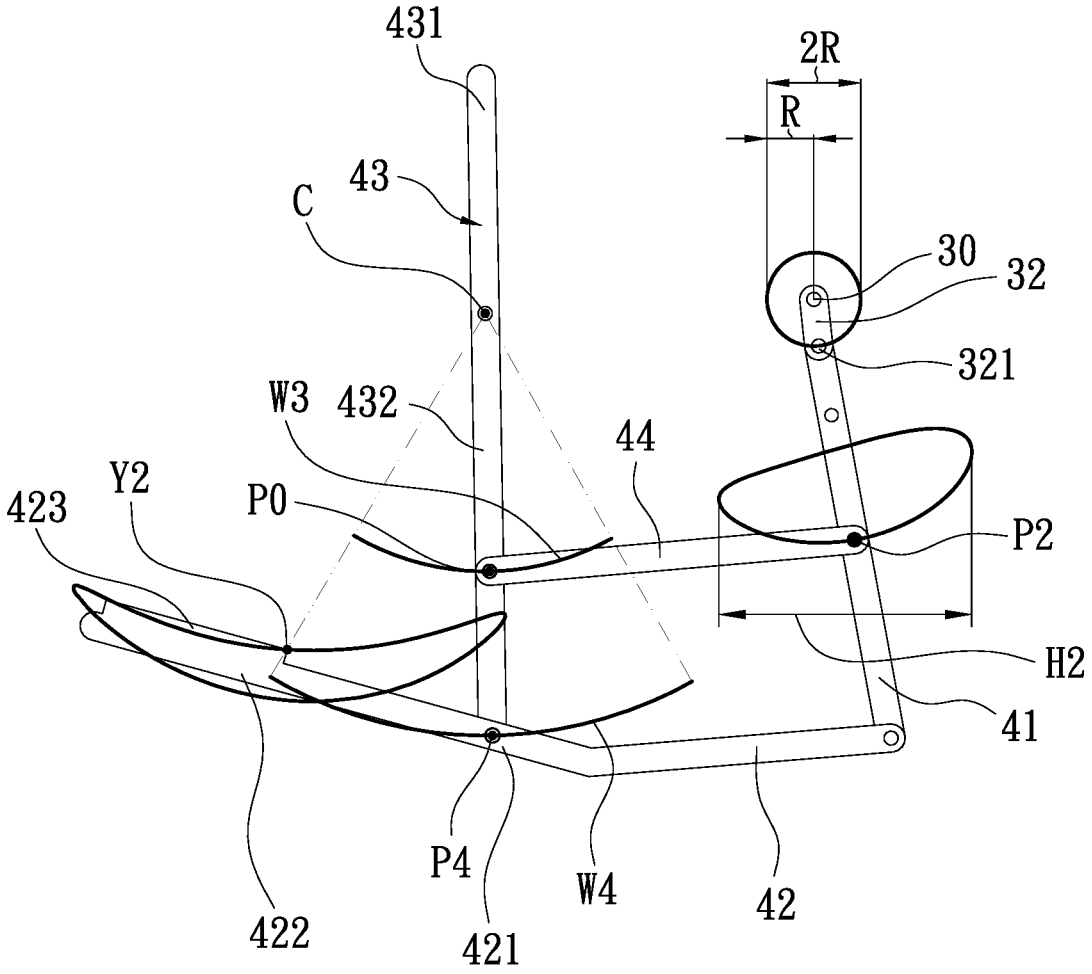
FIG. 5 is also another side plan view showing the operation of the elliptical exerciser according to the first embodiment of the present invention.

With reference to FIGS. 3-5, when stepping the pedal 423, a movement trajectory Y of the pedal 423 is an elliptical-like movement path (as shown in FIG. 3), wherein the elliptical-like movement path Y has an upper plane section and a lower arcuate section, thus decreasing sport injury and obtaining ergonomics and exercising safety. When stepping the pedal 423 and gripping the top segment 431 of the manual swing lever 43, the horizontal joining rod 44 actuates the adjustment lever 41 to drive the crank mechanism 3 to rotate, and the crank mechanism 3 actuates the pulley 21 of the transmission device 2 to revolve, such that the steel wheel 23 is driven by the belt 2 to enhance a stepping resistance, as shown in FIG. 3, wherein the second bolt 321 of the crank mechanism 3 rotates along the coupling shaft 30, a length of the second crank arm 32 of the crank mechanism 3 is a length R which is defined as a rotation radius length R, a circle rounding trajectory of the second bolt 321 is a circular moving trajectory, and a horizontal distance of the circle rounding trajectory of the second bolt 321 is a diameter length 2R. When the first end of the horizontal joining rod 44 is rotatably connected on the one of the three rotatable connection points 411, 412, 413 of the adjustment lever 41, the second rotatable fixing segment P of the first end of the horizontal joining rod 44 and the adjustment lever 41 is actuated by the crank mechanism 3 to produce the elliptical-like movement path, wherein a first horizontal distance H defined by the elliptical-like movement path is more than the horizontal distance 2R of the circle rounding trajectory of the second bolt 321, and the adjustment lever 41 drives the bottom segment 432 of the manual swing lever 43 via the horizontal joining rod 44 so that the third rotatable fixing segment P0 of the horizontal joining rod 44 and the bottom segment 432 of the manual swing lever 43 rotates along the rotatable connecting point C of the manual swing lever 43 to produce an arcuate movement trajectory. When desiring to adjust a foot movement trajectory, the second rotatable fixing segment P of the first end of the horizontal joining rod 44 and the adjustment lever 41 is adjustable so as to change the first horizontal distance H defined by the elliptical-like movement path, wherein the manual swing lever 43 rotates along the rotatable connecting point C of the manual swing lever 43, an arcuate swing length W of the third rotatable fixing segment P0 of the horizontal joining rod 44 and the bottom segment 432 of the manual swing lever 43 changes so as to adjust the foot movement trajectory and the stride length of the pedal 423.

Referring to FIGS. 3 and 4, when the second rotatable fixing segment P of the first end of the horizontal joining rod 44 and the adjustment lever 41 is located on a highest rotation point P1 of the adjustment lever 41, the second rotatable fixing segment P on the highest rotation point P1 produces a second horizontal distance H1 defined by the elliptical-like movement path, and the second horizontal distance H1 is shortest so that the third rotatable fixing segment P0, a second arcuate swing length W1 of the third rotatable fixing segment P0 of the horizontal joining rod 44, the post 42, and the manual swing lever 43 is shortest, and a third arcuate swing length W2 of the first rotatable fixing segment P4 is shortest, wherein the movement trajectory Y of the pedal 423 is a first closed circle rounding trajectory Y in a small distance. When the second rotatable fixing segment P of the horizontal joining rod 44 and the adjustment lever 41 is located on a lowest rotation point P2 of the adjustment lever 41, as shown in FIG. 5, the second rotatable fixing segment P on the lowest rotation point P2 produces the elliptical-like movement path, and a third horizontal distance H2 defined by the elliptical-like movement path is longest so that a fourth arcuate swing length W3 of the third rotatable fixing segment P0 of the horizontal joining rod 44, the post 42, and the manual swing lever 43 is longest, and a fifth arcuate swing length W4 of the first rotatable fixing segment P4 is longest, wherein the movement trajectory Y of the pedal 423 is a second closed circle rounding trajectory Y2 in a large distance, highest movement tension, and maximum intensity.

Figure 6:
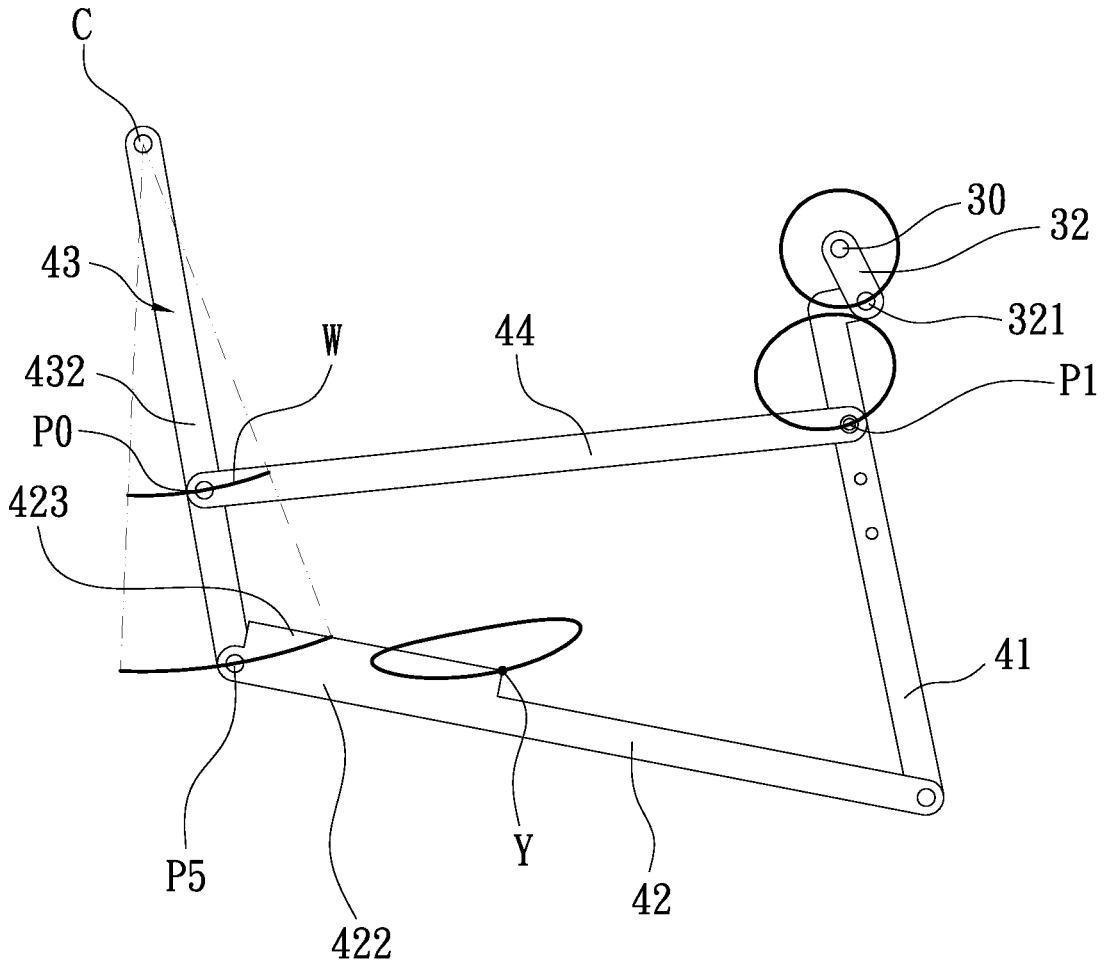
FIG. 6 is a side plan view showing the operation of the elliptical exerciser according to a second embodiment of the present invention.
Figure 7:
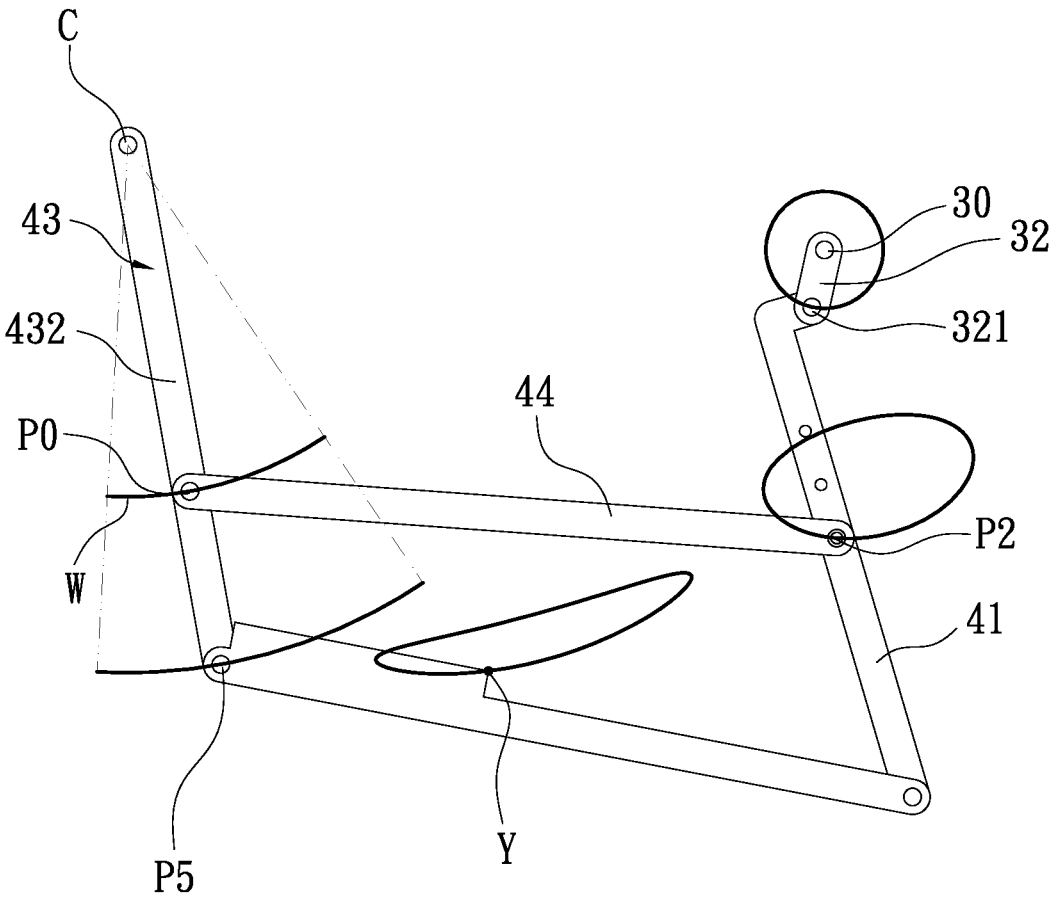
FIG. 7 is another side plan view showing the operation of the elliptical exerciser according to the second embodiment of the present invention.

With reference to FIGS. 6 and 7, a difference of a second embodiment of the elliptical exerciser from that of the first embodiment comprises: the bottom segment 432 of the manual swing lever 43 being connected to the distal segment 422 of the post 42, wherein a connection portion of the bottom segment 432 of the manual swing lever 43 and the distal segment 422 of the post 42 is a second rotatable fixing segment P5, thus decreasing sport injury and obtaining ergonomics and exercising safety.

Thereby, the second rotatable fixing segment P of the horizontal joining rod 44 and the adjustment lever 41 of the adjustment unit 4 is adjustable so that the first horizontal distance H defined by the elliptical-like movement path changes, and the manual swing lever 43 rotates along the rotatable connecting point C of the manual swing lever 43, wherein the arcuate swing length W of the third rotatable fixing segment P0 of the horizontal joining rod 44 and the bottom segment 432 of the manual swing lever 43 changes so as to adjust the foot movement trajectory and the stride length of the pedal 423. When stepping the pedal 423 of the elliptical exerciser, the movement trajectory Y of the pedal 423 is the elliptical-like movement path, wherein the elliptical-like movement path Y has the upper plane section and the lower arcuate section, thus decreasing sport injury and obtaining ergonomics and exercising safety.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. An elliptical exerciser comprising: a frame, a transmission device, a crank mechanism, and an adjustable movement unit; wherein the transmission device is connected on the frame and includes a pulley;

the crank mechanism is coaxial with the pulley of the transmission device and is rotatably connected on the frame, the crank mechanism includes a first bolt and a second bolt;

the adjustable movement unit is rotatably connected on the frame and is coupled with the transmission device via the crank mechanism, the adjustable movement unit includes two four-connection-rod assemblies which are located on two sides of the frame, and a respective four-connection-rod assembly of the adjustable movement unit has an adjustment lever, a post, a manual swing lever, and a horizontal joining rod; and the adjustable movement unit is rotatably connected on the second bolt of the crank mechanism, a top of the adjustment lever is rotatably connected on the second bolt of the crank mechanism, and a bottom of the adjustment lever is coupled with a first end of the post, wherein the adjustment lever has multiple rotatable connection points which are spaced, and the manual swing lever is rotatably connected on the frame, wherein the manual swing lever are defined to a top segment and a bottom segment by using a rotatable connecting point of the manual swing lever, and the bottom segment is connected to a second end of the post, wherein the post has a pedal connected on a distal segment thereof, a first end of the horizontal joining rod is rotatably connected on one of the multiple rotatable connection points of the adjustment lever, a connection portion of the first end of the horizontal joining rod and the one of three rotatable connection points is defined as a first rotatable fixing segment, and a second end of the horizontal joining rod is rotatably connected on a middle section of the bottom segment of the manual swing lever, wherein a connection portion of the second end of the horizontal joining rod and the middle section of the bottom segment is defined as a second rotatable fixing segment.

2. The elliptical exerciser as claimed in claim 1, wherein the frame includes a pedestal, a first fixing rod and a second fixing rod which are mounted on two ends of the pedestal, a first column extending upward from one of the two ends of the pedestal proximate to the first fixing rod, a second column extending upward from a middle section of the pedestal, and a control member fixed on a top of the second column, wherein the pedestal further includes two stems extending symmetrically outward from the second column below the control member, and two handrails connected on and extending upward from two sides of the second fixing rod of the pedestal and defined among the two stems and the second fixing rod.

3. The elliptical exerciser as claimed in claim 2, wherein the transmission device further includes a belt and a steel wheel, wherein the pulley is mounted on a top of the first column of the pedestal, and the first column has a rotatable connection seat disposed thereon beside the steel wheel and below the pulley, wherein the belt is fitted on the pulley and a pillar of the steel wheel.

4. The elliptical exerciser as claimed in claim 1, wherein the crank mechanism includes a coupling shaft coaxial with the pulley of the transmission device and is rotatably connected on the frame, wherein a first end of the coupling shaft is rotatably connected on a first end of a first crank arm, a second end of the first crank arm is rotatably connected with the first bolt, a second end of the coupling shaft is rotatably connected on a first end of a second crank arm, and a second end of the second crank arm is rotatably with the second bolt.

5. The elliptical exerciser as claimed in claim 2, wherein the manual swing lever is rotatably connected on the two stems of the frame, wherein the bottom segment is connected to an intermediate section of the post, and a connection portion of the bottom segment and the intermediate section is a third rotatable fixing segment.

6. The elliptical exerciser as claimed in claim 2, wherein the bottom segment of the manual swing lever is connected to the distal segment of the post, wherein a connection portion of the bottom segment of the manual swing lever and the distal segment of the post is a third rotatable fixing segment.

7. The elliptical exerciser as claimed in claim 5, wherein when the adjustable movement unit operates, the connection portion of the horizontal joining rod and the adjustment lever produces an elliptical-like movement path, and the second rotatable fixing segment of the horizontal joining rod and the manual swing lever rotates along the rotatable connecting point of the manual swing lever to produce an arcuate movement trajectory.

* * * * *